United States Patent [19]

Utsunomiya et al.

[11] Patent Number: 4,886,108

[45] Date of Patent: Dec. 12, 1989

[54] METHOD FOR FORMING A FIBER-REINFORCED METAL SHEET

[75] Inventors: Shin Utsunomiya; Mitsuhiro Okumura; Takeshi Morita, all of Amagasaki, Japan

[73] Assignees: Agency of Industrial Science and Technology; Mitsubishi Denki Kabushiki Kaisha, both of Tokyo, Japan

[21] Appl. No.: 250,230

[22] Filed: Sep. 28, 1988

[30] Foreign Application Priority Data

Jun. 27, 1988 [JP] Japan ..... 63-156860

[51] Int. Cl.[4] ..... B22D 11/00

[52] U.S. Cl. ..... 164/461; 164/48; 164/492; 164/494; 164/80; 164/97; 164/98; 164/103

[58] Field of Search ..... 164/48, 76.1, 80, 91, 164/97, 98, 103, 461, 492, 494; 148/11.5

[56] References Cited

U.S. PATENT DOCUMENTS 4,691,758 9/1987 Utsunomiya ..... 164/461

FOREIGN PATENT DOCUMENTS 1171609 7/1984 Canada ..... 164/80

53642 3/1984 Japan ..... 164/80

OTHER PUBLICATIONS

Summary of a lecture in the Japan Institute of Metals (Published the Autumn of 1987, 1987/10 p. 592).

1987–88 Poster Booklet (A Concise Review ofr Composite Research at the University of Delaware Center for Composite Materials).

*Primary Examiner*—Richard K. Seidel

*Assistant Examiner*—Edward A. Brown

*Attorney, Agent, or Firm*—Oblon, Spivak, McClelland, Maier & Neustadt

[57] ABSTRACT

A method for forming a fiber-reinforced metal sheet including the steps of preparing a wire preform in which fibers and a matrix are combined together; arranging regularly a plurality of wire preforms in a predetermined direction in a side-by-side relation; irradiating simultaneously using a $CO_2$ laser beam, and a YAG laser beam the regularly arranged wire preforms to elevate the temperature of the wire preforms; and pressing the wire preforms by rollers while the wire preforms are at the elevated temperature.

7 Claims, 4 Drawing Sheets

METHOD FOR FORMING A FIBER-REINFORCED METAL SHEET

BACKGROUND OF THE INVENTION

1. FIELD OF THE INVENTION

The present invention relates to a method for forming a fiber-reinforced metal sheet. More particularly, it relates to a method for forming a fiber-reinforced metal sheet in which press rollers and a plurality of laser beams are used.

2. DISCUSSION OF THE BACKGROUND

As a method for forming a fiber-reinforced metal sheet, there is a proposal to manufacture a thin sheet of the fiber-reinforced metal by using a plurality of wire preforms as an elemental material, each being formed by combining fibers and a matrix and the wire preforms being arranged in one direction in a side-by-side relation; and by pressing them immediately after a laser beam has been irradiated onto the regularly arranged wire to thereby bond the wire preforms together (The Summary of Lecture in the Japan Metal Academy, p. 592, October, 1982).

FIG. 3 shows schematically the idea of forming a fiber-reinforced metal sheet.

A plurality of wire preforms 1 are regularly arranged on a supporting plate in a parallel relation in the longitudinal direction of the supporting plate 5, and are transferred to a pair of press rollers 2. Just before pressing the wire preforms 1 by the press rollers 2, a laser beam 3 irradiates to the wire preforms 1. The wire preforms 1 are heated to a temperature to cause the matrix in the preforms to melt by the irradiation of the laser beam 3. The wire preforms 1 are pressed by the rollers in an elevated temperature condition, whereby a strong pressing force is applied to the wire preforms to thereby form a one-piece structure. In order to simultaneously join the plurality of wire preforms 1, a light-focusing device 4 is provided so that the laser beam 3 can be uniformly emitted to the plurality of wire preforms. In this case, it is necessary that the laser beam 3 having a distribution of a linear form (FIG. 4*a*) or a trapezoidal form (FIG. 4*b*) is given to the wire preforms by the beam focusing device 4.

In the conventional method of forming the fiber-reinforced metal sheet, a $CO_2$ laser or a YAG laser has been solely used to produce a laser beam.

For the wire preform, silicon-carbide-fiber-reinforced aluminum and carbon-fiber-reinforced aluminum are used. These materials constitute an elemental material in the method of forming the fiber-reinforced metal sheet according to the present invention. However, when a laser beam is used as a heating source for wire preforms having an aluminum matrix, the following disadvantage is found.

When a $CO_2$ laser is used, the reflection factor of metals constituting the matrix of the wire preforms is high as shown in Table 1. For instance, the reflection factor of aluminum is as high as about 97%. Namely, the absorption factor of the $CO_2$ laser becomes remarkably low. Accordingly, a remarkably large power of irradiation is needed in comparison with energy required to heat the wire preforms to a temperature necessary to form the wire preforms in one piece by the rollers. On the other hand, the absorption factor of the $CO_2$ laser in the wire preforms is strongly influenced by factors such as the surface properties of the wire preforms and the distance between the adjacent wire preforms. Accordingly, when the absorption factor is extremely low, the condition of joining the wire preforms is greatly affected by the physical properties, whereby the condition of forming the fiber-reinforced metal sheet becomes unstable.

TABLE 1

| Metal | Reflection factor of major metal/laser: YAG laser, wavelength of 0.9–1.1 μm | $CO_2$ laser, wavelength of 0.9–1.1 μm |
|---|---|---|
| Al | 73.3 | 96.9 |
| Cu | 90.1 | 98.4 |
| Fe | 65.0 | 93.8 |
| Mg | 74.0 | 93 |
| C | 26.8 | 59.0 |

(Laser-applied technique handbook, Asakura (1984) p.80)

On the other hand, when the YAG laser is used independently, the reflection factor of the YAG laser by aluminum as the matrix in the wire preforms is lower than that of the $CO_2$ laser although the reflection factor of the YAG laser is still high. However, an oscillating device having a large output can not be obtained by the YAG laser in comparison with the $CO_2$ laser. For instance, the maximum output obtained by the $CO_2$ laser oscillating device is 20 kW, while the maximum output by the YAG laser is 0.6 kW. Accordingly, when a laser beam is spread out in order to simultaneously join a number of wire preforms, the power of irradiation per unit surface area is insufficient.

SUMMARY OF THE INVENTION

It is an object of the present invention to provide a method for forming fiber-reinforced metal sheet by using a plurality of laser beams wherein the absorption factor of the laser beams is a whole improved, a number of wire preforms can be simultaneously joined and the joining conditions are stabilized.

The foregoing and the other objects of the present invention have been attained by providing a method for forming a fiber-reinforced metal sheet which comprises preparing a wire preform in which fibers and a matrix are combined together; arranging regularly a plurality of wire preforms in a predetermined direction in a side-by-side relation; irradiating the preforms simultaneously with a $CO_2$ laser beam and a YAG laser beam to elevate the temperature of the wire preforms; and pressing the wire preforms by rollers while the wire preforms are heated.

As the fibers used in the present invention, silicon carbide fibers or carbon fibers may be used as reinforcing fibers for a matrix metal.

As the matrix used in the present invention, aluminum, copper, iron or magnesium is preferably used.

As the elemental material used in the present invention, a wire preform prepared by combining the fibers and the matrix is used. Even when the matrix is heated at a temperature to cause the matrix to melt, the wire preform can keep its configuration by the fibers incorporated therein, and it is easy to press the wire preform by the rollers. In the present invention, there is a small possibility of causing an inner defect in a press-formed product in comparison with the case that a metal as a matrix and fibers are separately used as elemental materials, and they are formed in one piece by pressing them by rollers.

A predetermined number of wire preforms are arranged on a supporting plate in a predetermined direction in a side-by-side relation so that when they are subjected to a pressing operation by the rollers, they can be strongly pressed. simultaneously irradiated to the regularly arranged wire preforms, they are heated at a temperature which allows a hot pressing operation by the rollers. It is desirable that the irradiation of the laser beams is carried out just before the pressing operation by the rollers. The rate of temperature rise in the wire preforms by the irradiation of the laser beams is much faster than that obtained by the other heating method, whereby the deterioration of the fibers caused at a high temperature condition can be minimized.

The function of the two kinds of lasers is considered as follows.

The YAG laser is mainly used for preheating the wire preforms. The absorption factor of the YAG laser in aluminum in the matrix of the wire preforms is higher than that in the case of the $CO_2$ laser. Although the YAG laser is insufficient to heat the wire preforms to a temperature causing the matrix to melt, it is possible to elevate the temperature of the wire preforms to some extent when the YAG laser beam is spread out to irradiate simultaneously a number of wire preforms. Further, the fluctuation in temperature rise in the wire preforms obtained by using the YAG laser is small in comparison with the $CO_2$ laser.

The $CO_2$ laser is mainly used for heating the wire preforms to a temperature at which the matrix is molten. Aluminum and the other metal used for the matrix possesses such absorption characteristics that the absorption factor of the $CO_2$ laser increases as temperature rises. Accordingly, the absorption factor of the $CO_2$ laser with respect to the wire preforms can be substantially improved by elevating sufficiently temperature by the YAG laser. According to experiments by the inventors of this application in the case that the laser irradiation is conducted independently, there is a critical value of power of irradiation between the power of irradiation and the deformation by heat of the wire preforms. When the value of power of irradiation is smaller than the critical value, there is little substantial change of the wire preforms, and when it exceeds the critical value, there is a rapid temperature rise to thereby cause the deformation of the wire preforms. Although the cause is not clear, it is considered that it depends on the variation with temperature of the absorption factor. The critical value of power of irradiation can be reduced by irradiating with the YAG laser and the $CO_2$ laser simultaneously.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
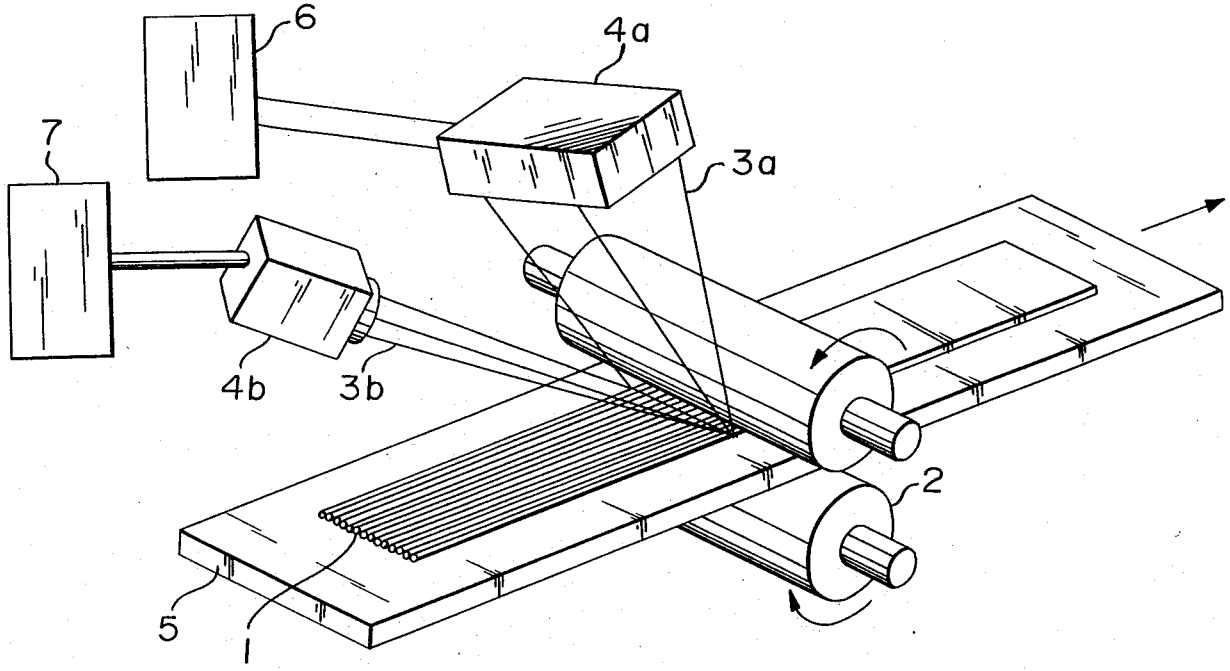
FIG. 1 is a diagram showing an embodiment of the method for forming a fiber-reinforced metal sheet according to the present invention.

Referring to the drawings, wherein the same reference numerals designate the same or corresponding parts throughout the several views, and more particularly to FIG. 1 thereof there is shown a diagram of a typical example of the method for forming a fiber-reinforced metal sheet of the present invention. In FIG. 1, reference numeral 1 designates a plurality of wire preforms which are placed on a supporting plate 5 in a side-by-side relation in the longitudinal direction of the supporting plate and are fixed thereon. A numeral 6 designates a $CO_2$ laser oscillating device to generate a $CO_2$ laser beam 3*a* which is focused by a focusing device 4*a*, whereby the laser beam 3*a* irradiates the wire preforms 1.

A numeral 7 designates a YAG laser oscillating device to generate a YAG laser beam 3*b* which is focused by a focusing device 4*b*, whereby the focused YAG laser beam 3*b* irradiates the wire preforms 1 together with the $CO_2$ laser beam 3*a*.

A pair of press rollers 2 press the wire preforms 1 by receiving therebetween the wire preforms 1 together with the supporting plate 5. The supporting plate 5 is to protect the rollers and to prevent the wire preforms 1 from sticking on the rollers. The supporting plate may be used as a delivering means in which the wire preforms 1 are fixed.

Figure 4:
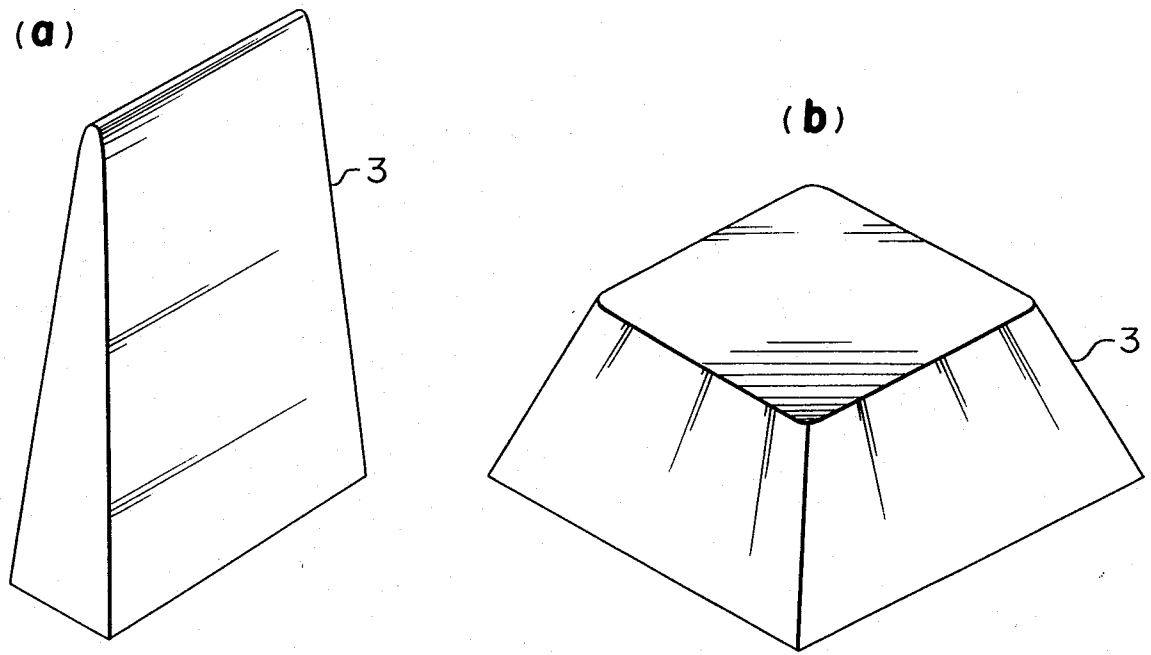
FIGS. 4*a* and 4*b* respectively are diagrams showing the shapes of laser beams.

As the wire preforms used for the fiber-reinforced metal sheet in the present invention, unidirectional silicon-carbide-fiber-reinforced aluminum (manufactured by Nippon Carbon Kabushiki Kaisha, the matrix satisfying JIS A1050) or unidirectional carbon-fiber-reinforced aluminum (manufactured by MCI Inc. in U.S.A., the matrix satisfying JIS A 6061) may be used. The diameter of the wire preform is 0.5 mm. A plurality of the wire preforms are regularly arranged on the supporting plate 5 in one direction to form a single layer, and are fixed thereon. After the supporting plate 5 has been inserted between the press rollers 2, the rotation of the press rollers 2 is started so that the wire preforms 1 are pressed by the rollers 2. The $CO_2$ laser beam 3*a* and the YAG laser beam 3*b* are irradiated onto the wire preforms 1 just before the wire preforms are pressed by the press rollers 2. With the focusing devices 4*a* and 4*b*, both laser beams are focused to be a beam having a linear distribution of power density as shown in FIG. 4*a*, whereby the beam is uniformly applied to the wire preforms 1 in their transverse direction. In this embodiment, the power density of the $CO_2$ laser beam is $0.5\text{–}3\times10^7$ W/m$^2$ and the power density of the YAG laser beam is $0.1\text{–}2\times10^6$ W/m$^2$. And the speed of pressing is $1\text{–}50\times10^{-3}$ m/s. Under these conditions, it was possible to form a thin sheet of fiber-reinforced metal.

Figure 2:
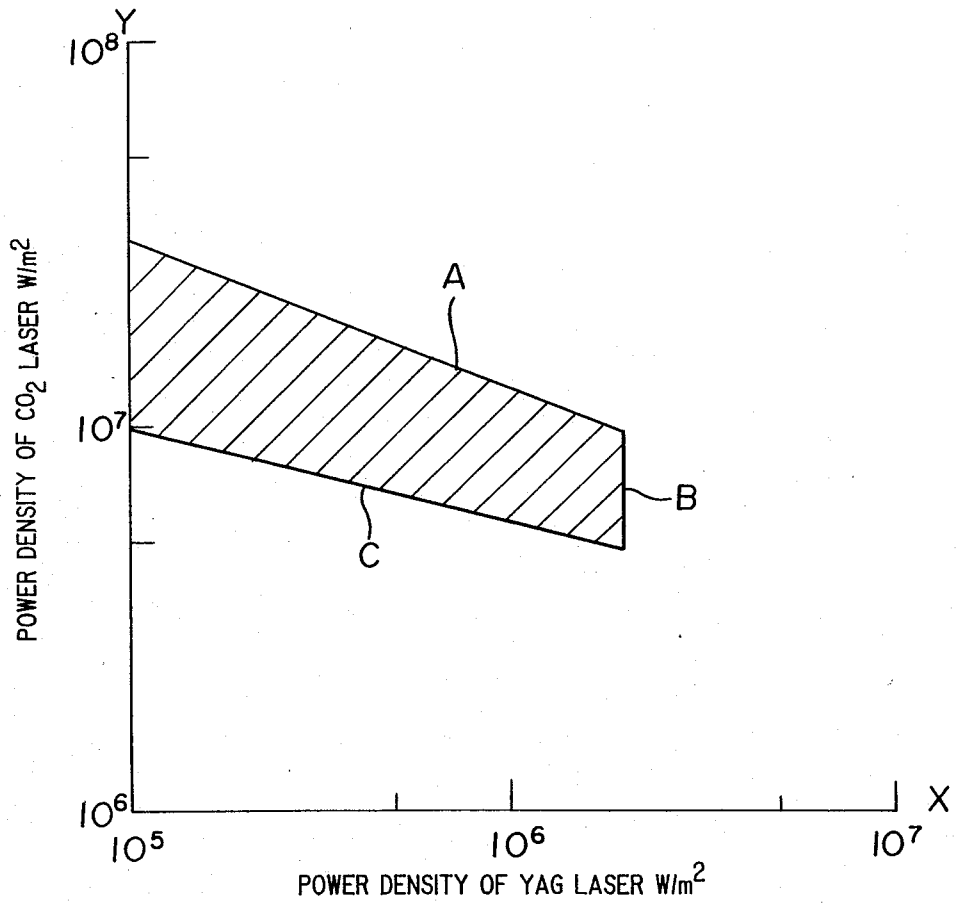
FIG. 2 is a graph showing a range of condition allowing the formation of the fiber reinforced metal sheet of the present invention.
Figure 3:
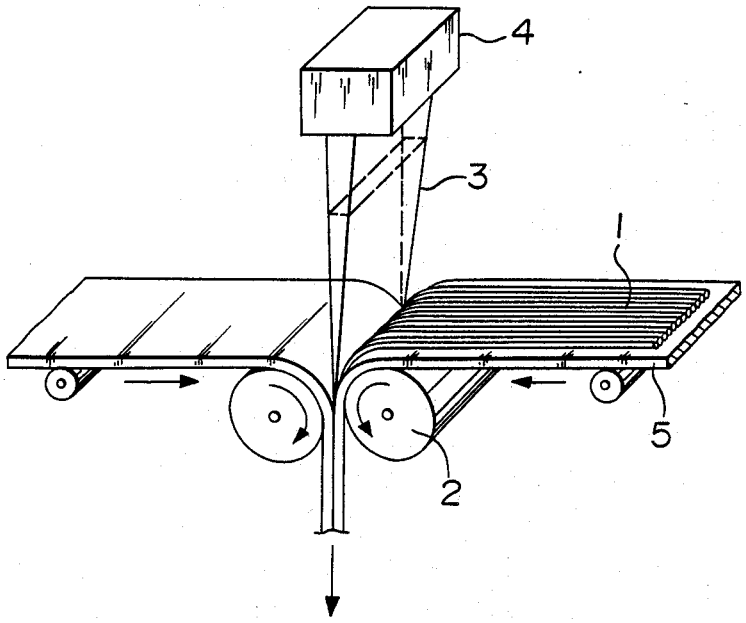
FIG. 3 is a diagram showing a conventional method for forming a fiber-reinforced metal sheet.

In FIG. 2, a range of power density in the combination of the $CO_2$ laser beam and the YAG laser beam which allows the formation of the fiber-reinforced metal sheet of the present invention is shown by a region surrounded by the Y axis and lines A, B and C. The thickness of the sheet obtained by the method of the present invention was 0.35 mm. When the irradiation power of the laser beam is excessively high, the wire preforms are extremely damaged. When the irradiation power is too low, the wire preforms can not be sufficiently joined. Temperature rise in the wire preforms is controlled by the irradiation power of the laser beam and the pressing speed.

As a Comparative Example, a fiber-reinforced metal sheet was prepared by irradiating with a single laser beam. In this case, there was found a condition permitting the joining in a range of the power density of the $CO_2$ laser beam of $1-3\times10^7$ W/m$^2$ and the power density of the YAG laser beam of $1-3\times10^6$ W/m$^2$. In comparing the Comparative Example with the above-mentioned embodiment of the present invention, a fiber-reinforced metal sheet can be prepared by a relatively low power density of laser beam in the present invention.

In the above-mentioned embodiment, the laser beam having a linear distribution of power density is used. However, the same effect can be obtained by using a laser beam having a trapezoidal distribution of power density.

The focusing device for focusing the laser beam may be a lens, a mirror or a driving type mirror as far as a predetermined distribution of power density can be obtained.

Although it is preferable that the laser beam is applied to the wire preforms just before they enter into the paired press rollers, a sufficient effect can be obtained as far as the laser beam is applied to the wire preforms at a position sufficiently close to the press rollers. It is unnecessary that the YAG laser beam and the $CO_2$ laser beam are simultaneously applied to the same location on the wire preforms if preheating function by the YAG laser beam can be obtained.

A gas environment may be formed in an area where the laser beam irradiates or in a part of a forming device including the area where the laser beam irradiates. The condition of forming a fiber-reinforced metal sheet can be stabilized by forming an inert gas environment.

According to experiments on the irradiation by a single laser beam by the inventors, it was found that the absorption factor of the YAG laser beam to the wire preforms is higher than that described in the literature, so that the wire preforms can be joined in a relatively stable manner. Thus, the $CO_2$ laser irradiates onto the wire preforms at the same time as the irradiation of the YAG laser having insufficient irradiation power to thereby improve the method for forming fiber-reinforced metal sheet.

In accordance with the present invention, the condition of forming a thin sheet of fiber-reinforced metal can be expanded by simultaneously irradiating with the $CO_2$ laser beam and the YAG laser beam. Further, the fiber-reinforced metal sheet can be manufactured in a stable manner. Further, in the present invention, a number of wire preforms can be simultaneously formed by using an oscillating device having the same output in comparison with the conventional method in which a single laser beam is irradiated. Also, a laser oscillating device having a small output can be used when the same number of wire preforms are to be formed.

Obviously, numerous modifications and variations of the present invention are possible in light of the above teachings. It is therefore to be understood that within the scope of the appended claims, the invention may be practiced otherwise than as specifically described herein.

What is claimed is:

1. A method for forming a fiber-reinforced metal sheet which comprises:

preparing a wire preform in which fibers and a matrix are combined together;

arranging regularly a plurality of wire preforms in a predetermined direction in a side-by-side relation;

irradiating simultaneously with a $CO_2$ laser beam and a YAG laser beam said regularly arranged wire preforms to elevate the temperature of the wire preforms; and pressing said wire preforms by rollers while said wire preforms are at said elevated temperature.

2. The method according to claim 1, wherein said $CO_2$ laser beam and said YAG laser beam irradiate said wire preforms just before they are subjected to said pressing operation by said rollers.

3. The method according to claim 1, wherein said regularly arranged wire preforms are carried on a supporting plate and are moved to said rollers.

4. The method according to claim 1, wherein said $CO_2$ laser beam and said YAG laser beam are respectively emitted onto said regularly arranged wire preforms in a linear distribution of power density.

5. The method according to claim 1, wherein said $CO_2$ laser beam and said YAG laser beam are respectively emitted onto said regularly arranged wire preforms in a trapezoidal distribution of power density.

6. The method according to claim 1, wherein said fibers are silicon carbide fibers or carbon fibers.

7. The method according to claim 1, wherein said matrix is a material selected from a group consisting of aluminum, copper, iron and magnesium.

* * * * *